US006588407B2

(12) United States Patent
Fewell, Jr.

(10) Patent No.: US 6,588,407 B2
(45) Date of Patent: Jul. 8, 2003

(54) DISCHARGE IGNITION APPARATUS FOR INTERNAL COMBUSTION ENGINE HAVING AUTOMATIC SPARK ADVANCE

(75) Inventor: Roy J. Fewell, Jr., Aiken, SC (US)

(73) Assignee: R.E. Phelon Company, Inc., Aiken, SC (US)

( * ) Notice: Subject to any disclaimer, the term of this patent is extended or adjusted under 35 U.S.C. 154(b) by 93 days.

(21) Appl. No.: 09/875,550

(22) Filed: Jun. 6, 2001

(65) Prior Publication Data

US 2002/0185108 A1 Dec. 12, 2002

(51) Int. Cl.[7] ..... F02P 9/00; F02P 3/02
(52) U.S. Cl. ..... 123/618; 123/620
(58) Field of Search ..... 123/618, 619, 123/620, 406.66, 406.57, 149 D

(56) References Cited

U.S. PATENT DOCUMENTS

| | | | | |
|---|---|---|---|---|
| 3,515,109 A | | 6/1970 | Farr | |
| 3,646,667 A | | 3/1972 | Janisch | |
| 3,651,795 A | | 3/1972 | Noddin | |
| 3,661,132 A | | 5/1972 | Farr | |
| 3,722,488 A | | 3/1973 | Swift et al. | |
| 3,809,040 A | | 5/1974 | Burson et al. | |
| 3,838,671 A | | 10/1974 | Farr | |
| 4,079,712 A | | 3/1978 | Nagasawa | |
| RE31,837 E | | 2/1985 | Burson | |
| 4,538,586 A | | 9/1985 | Miller | |
| 4,606,323 A | * | 8/1986 | Nash | 123/406.57 |
| 4,611,570 A | * | 9/1986 | Nash | 123/406.57 |
| 4,746,825 A | | 5/1988 | Phelon | |
| 5,513,619 A | | 5/1996 | Chen et al. | |
| 5,606,958 A | | 3/1997 | Chrintz-Gath et al. | |
| 5,806,503 A | | 9/1998 | McLeod | |
| 5,829,421 A | | 11/1998 | McLeod | |
| 5,855,199 A | | 1/1999 | McLeod | |
| 5,931,137 A | | 8/1999 | McLeod et al. | |

* cited by examiner

*Primary Examiner*—Mahmoud Gimie
(74) *Attorney, Agent, or Firm*—Nelson Mullins Riley & Scarborough

(57) ABSTRACT

A capacitive discharge ignition apparatus provides spark advance with engine speed. The ignition apparatus includes triggering circuitry connected to the primary coil of the high voltage transformer. The triggering circuitry produces a triggering signal based on voltage induced in the primary coil by revolution of a permanent magnet. The triggering circuitry is adapted to provide the triggering signal at low RPMs on the trailing edge of a predetermined half cycle. At higher RPMs, the triggering signal shifts to the leading edge of the half-cycle so as to advance the spark.

29 Claims, 5 Drawing Sheets

DISCHARGE IGNITION APPARATUS FOR INTERNAL COMBUSTION ENGINE HAVING AUTOMATIC SPARK ADVANCE

BACKGROUND OF THE INVENTION

The present invention generally relates to ignition systems for gasoline engines. More particularly, the invention relates to a discharge ignition apparatus that provides automatic spark advance at predetermined operating speeds.

Ignition circuits of relatively elaborate design have often been provided to advance the ignition spark as engine speed is increased. For example, the spark may be delayed at starting speeds until approximately peak compression of the engine's piston. At higher engine speeds, the spark is preferably advanced to occur before peak compression. For example, it may be desirable in many applications to have an advance of about fifteen (15) mechanical degrees.

SUMMARY OF THE INVENTION

In one aspect, the present invention provides an ignition apparatus for use with an internal combustion engine to produce an electrical spark at a spark ignition device. The apparatus comprises a magnet assembly, including a pair of pole faces, operatively revolved along a circular path. A magnetically permeable core is mounted adjacent to the circular path and has at least two leg portions each including a respective end face. The leg portions of the magnetically permeable core are situated such that the pole faces pass proximate to the end faces during revolution of the magnet assembly. As a result, a time-varying magnetic flux is produced in the magnetically permeable core.

The ignition apparatus further includes a transformer having a primary coil and a secondary coil related by a predetermined step-up ratio. The secondary coil is electrically connected during operation to the spark ignition device. A spark generation circuit is operative to apply a primary voltage pulse to the primary coil responsive to a triggering signal. The primary voltage pulse produces a spark generating pulse in the secondary coil.

In addition, the ignition apparatus includes triggering circuitry electrically connected to the primary coil to produce the triggering signal based on a voltage induced in the primary coil by revolution of the magnet assembly. The triggering circuitry is adapted so as to automatically produce advancement of the triggering signal at predetermined operating speeds.

In some exemplary embodiments, the ignition apparatus comprises an energy storage element such as a charge capacitor. A charge coil has a voltage induced thereon by the magnetic flux to supply charging energy to the energy storage element during each revolution of the magnet assembly. An electronic switch, such as an SCR, is electrically connected in circuit with the energy storage element and the primary coil. The electronic switch is rendered conductive by application of the triggering signal thereto. Often, it will be desirable to locate the transformer and the charge coil on different leg portions of the magnetically permeable core.

The triggering circuitry may preferably comprise a peak detect circuit operative to indirectly produce the triggering signal from voltage induced in the primary coil when the triggering signal is not advanced. When the triggering signal is advanced, connection circuitry are operative to directly produce the triggering signal from voltage induced in the primary coil. For example, the triggering circuitry may be adapted such that the triggering signal is produced on a trailing edge of a predetermined half cycle of the primary coil induced voltage when not advanced and is produced on a leading edge of the half cycle when advanced.

The peak detect circuit may be configured having a diode electrically connected to a holding capacitor. In such embodiments, the holding capacitor may be selectively discharged by a trigger switch so as to produce the triggering signal. Often, the trigger switch may a transistor (such as a PNP bipolar transistor).

In presently preferred embodiments, the ignition apparatus may be configured so that the triggering signal will advance by at least about 10 degrees. For example, the triggering signal may preferably advance by about 14–15 degrees in some exemplary embodiments. Moreover, it will often be desirable if the triggering signal when advanced occurs at a time when a spark sustaining potential is being otherwise induced on the secondary coil.

In other aspects, the present invention provides a discharge circuit for use in a discharge ignition system of the type operative to produce an electrical spark at a spark ignition device. The discharge circuit comprises a charge capacitor, a charge coil and a rectifier electrically connected between the charge coil and the charge capacitor. A transformer is also provided, including a primary coil and a secondary coil. The secondary coil is electrically connected during operation to the spark ignition device to produce the electrical spark.

The discharge circuit further includes an electronic switch electrically connected in circuit with the charge capacitor and the primary coil. The electronic switch is rendered conductive by a triggering signal applied to a triggering node thereof. Toward this end, triggering circuitry is electrically connected to the triggering node. The triggering circuitry is operative to produce the triggering signal based on a voltage induced in the primary coil. Moreover, the triggering circuitry is adapted so as to automatically produce advancement of the triggering signal at predetermined operating speeds.

Additional aspects of the present invention are provided by a discharge ignition apparatus for use with an internal combustion engine to produce an electrical spark at a spark ignition device. The apparatus comprises a movable magnet assembly including a pair of pole faces. A magnetically permeable core is provided, having at least two leg portions each including a respective end face. The magnetically permeable core is mounted such that the pole faces pass proximate to the end faces as the magnet assembly is operatively moved in a cyclical manner to produce a time-varying magnetic flux in the magnetically permeable core. A housing is mounted to at least one of the leg portions of the magnetically permeable core. A transformer having a primary coil and a secondary coil is located in the housing and situated about the magnetically permeable core. The secondary coil of the transformer is electrically connected during operation to the spark ignition device.

The discharge ignition apparatus further comprises a discharge circuit located in the housing. The discharge circuit includes a charge coil situated about the magnetically permeable core to have a charging voltage induced thereon by the magnetic flux. As a result, charging energy is supplied to an energy storage element.

An electronic switch is electrically connected in circuit with the energy storage element and the primary coil. Activation of the electronic switch during operation produces a voltage on the primary coil. Toward this end, triggering circuitry is provided which is operative to activate the electronic switch at a first triggering point when the engine is operating at speeds below a predetermined threshold. When the engine is operating at speeds above the predetermined threshold, the triggering circuitry is operative to activate the electronic switch at a second triggering point. The second triggering point is advanced with respect to the first triggering point and occurs at a time when a spark sustaining potential is being otherwise induced on the secondary coil.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
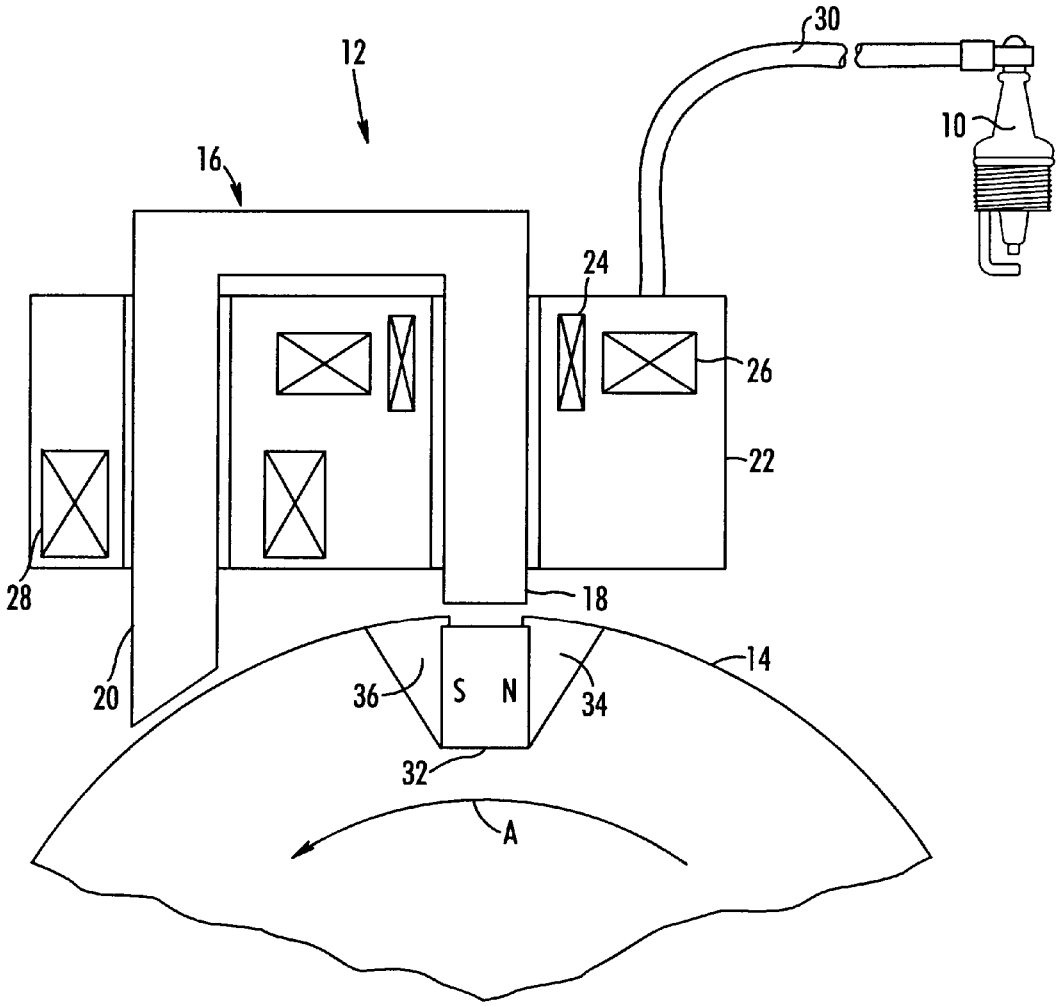
FIG. 1 is a diagrammatic elevational view showing various components in a discharge ignition system.

Repeat use of reference characters in the present specification and drawings is intended to represent same or analogous features or elements of the invention.

DETAILED DESCRIPTION OF THE PREFERRED EMBODIMENT

It is to be understood by one of ordinary skill in the art that the present discussion is a description of exemplary embodiments only and is not intended as limiting the broader aspects of the present invention, which broader aspects are embodied in the exemplary constructions.

FIG. 1 illustrates a discharge ignition apparatus that may be used with various devices powered by gasoline engines. The apparatus is configured to produce the requisite spark at spark plug 10 to ignite the air-fuel mixture within the piston cylinder of the engine. Generally, the apparatus includes a stator unit 12 and a rotatable flywheel 14. Flywheel 14 typically includes a central bore for mounting to a rotatable spindle mechanism interconnected with the engine's drive shaft. As a result, rotation of the spindle will produce a concomitant rotation of flywheel 14 (such as in the direction indicated by arrow A).

Stator unit 12, which typically remains fixed with respect to the engine during use, includes a magnetically permeable core 16. In this case, core 16 includes two depending leg portions, respectively indicated at 18 and 20. In many embodiments, however, the magnetically permeable core may be constructed having three such leg portions.

A sealed housing 22 maintains the various coils and other components utilized to produce a spark at spark plug 10. In particular, housing 22 includes a high voltage transformer having a primary coil 24 and a secondary coil 26. In the illustrated embodiment, coils 24 and 26 may be mounted coaxially about leg portion 18. A charge coil 28 provides a source of energy for the ignition spark as will be explained more fully below. In this case, charge coil 28 is mounted about leg portion 20 as shown.

The various coils and circuit components located within housing 22 may be protected and maintained securely in position by a suitable potting compound. Electrical connection with spark plug 10 is achieved by a typical interconnecting wire 30.

A magnet assembly is mounted adjacent the periphery of flywheel 14 to revolve about a circular path in synchronism with operation of the engine. The magnet assembly includes a permanent magnet 32 having pole pieces 34 and 36 mounted at respective ends thereof. It will be appreciated that the circumferential faces of pole pieces 34 and 36 will pass proximate to the end faces of leg portions 18 and 20 as flywheel 14 is rotated. Rotation of flywheel 14 thus produces a time-varying magnetic flux within core 16 as desired.

Figure 2:
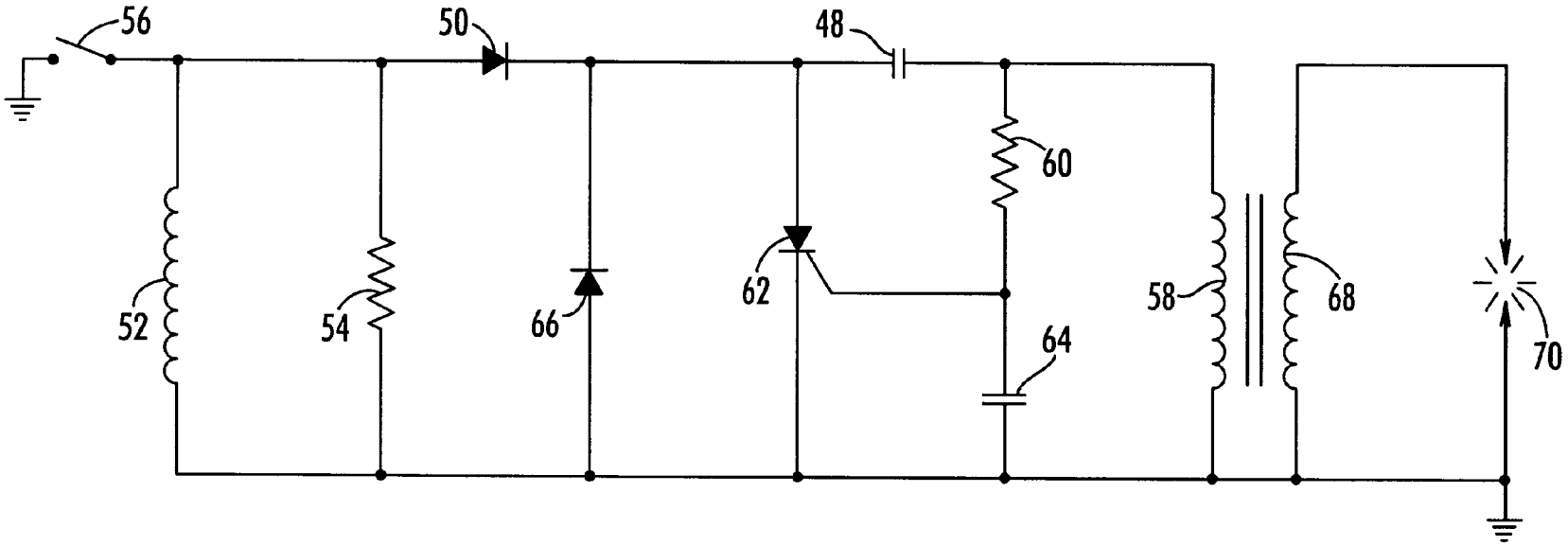
FIG. 2 PRIOR ART
FIG. 2 is a schematic diagram illustrating a prior art ignition circuit.

FIG. 2 illustrates a discharge circuit of the prior art. The circuit of FIG. 2 includes a charge capacitor 48 which is charged through rectifier diode 50 by a large positive pulse induced on charge coil 52. A resistor 54 is provided to attenuate transient voltages produced as diode 50 changes from forward conducting to reverse blocking. A stop switch 56 is provided to selectively ground charge coil 52 and thereby disable operation of the ignition system.

After capacitor 48 is charged, a relatively smaller positive pulse will be induced on primary coil 58 of the transformer. For example, the pulse induced on the primary coil may occur about 325° of rotation after the pulse induced on charge coil 52 in a system such as that shown in FIG. 1.

The positive primary coil signal is injected through a resistor 60 of relatively low resistance to the gate of silicon controlled rectifier (SCR) 62. When the triggering signal is produced in this manner by the voltage induced on primary coil 58, SCR 62 will be rendered conductive. As a result, capacitor 48 will discharge through primary coil 58. Capacitor 64 is optionally provided to shift the firing point a few degrees as may be required for a particular application. Ring-back diode 66 allows the tank circuit formed by capacitor 48 and the inductance of primary coil 58 to oscillate until all the energy initially stored in capacitor 48 dissipates.

The voltage appearing at primary coil 58 is stepped up by the predetermined ratio of the transformer. The higher voltage thus appearing at secondary coil 68 generates a spark across gap 70 of the spark plug. Because SCR 62 is fired at about the same point on the primary coil signal over the operating range of the engine, the timing is fixed at a predetermined number of degrees before top dead center (TDC).

Figure 3:
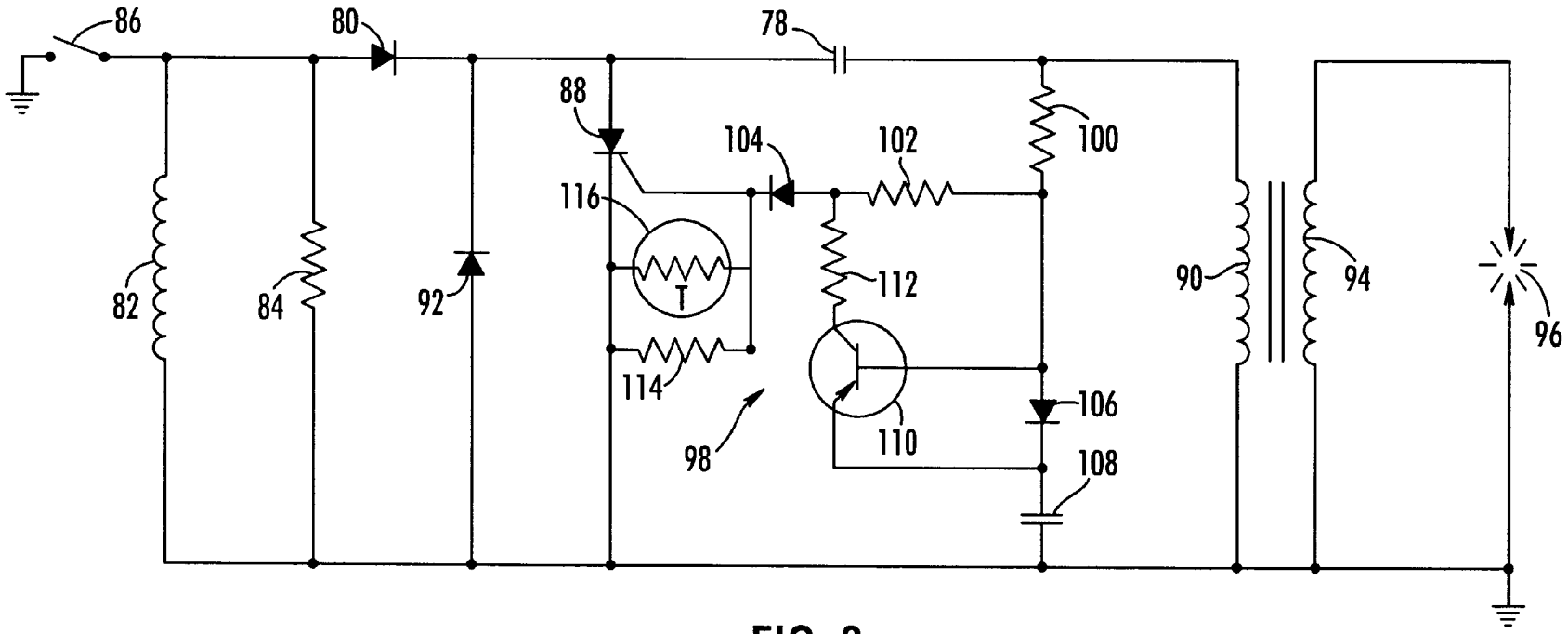
FIG. 3 is a schematic diagram of an exemplary ignition circuit constructed according to the present invention.

FIG. 3 illustrates an embodiment of a discharge circuit constructed in accordance with the present invention. It can be seen that the discharge circuit of FIG. 3 is similar to the discharge circuit of FIG. 2 in conventional aspects. For example, the discharge circuit of FIG. 3 includes a charge capacitor 78 which is charged through diode 80 by a large positive pulse induced on charge coil 82. Attenuation resistor 84 and stop switch 86 are also provided as in the circuit of the prior art.

When SCR 88 is rendered conductive, charge capacitor 78 discharges through the transformer's primary coil 90. The energy stored on capacitor 78 is permitted to oscillate in the conventional manner by ring back diode 92. The high voltage produced at secondary winding 94 is applied to spark plug gap 96.

Like the circuit of FIG. 2, the circuit of FIG. 3 utilizes the voltage induced on primary coil 90 due to revolution of the magnet assembly to provide a triggering signal to SCR 88. In this case, however, triggering circuitry 98 automatically provides an advance in the triggering signal at higher operating speeds. Unlike many arrangements of the prior art, spark advance is advantageously achieved without the use of separate trigger coils.

Figures 4A, 4B, 4C:
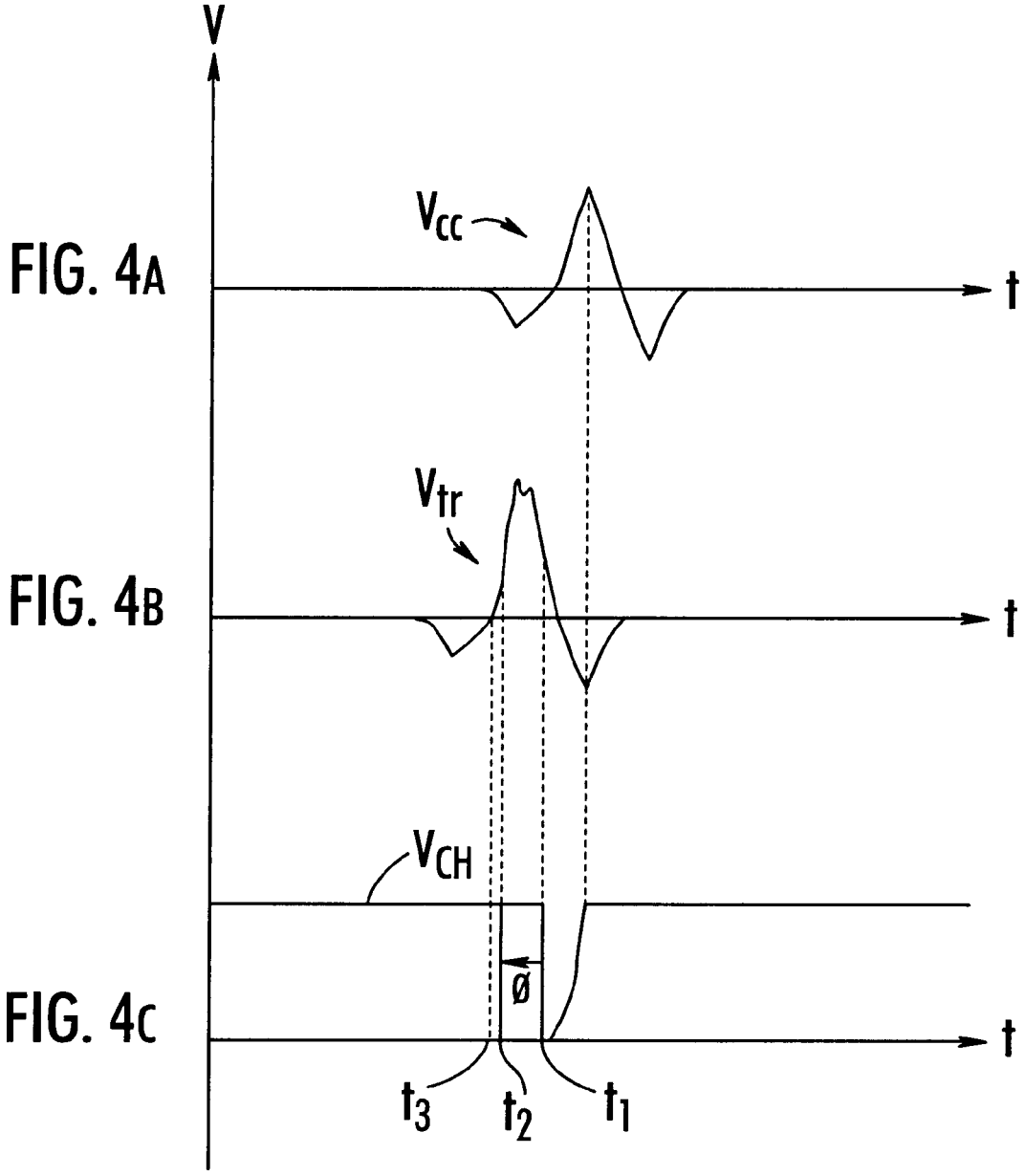
FIGS. 4A–4C diagrammatically illustrate various voltage plots taken at respective locations in the circuit of FIG. 3.

The operation of triggering circuitry 98 will now be explained with reference to the remaining figures. In this regard, FIG. 4A shows the waveform $V_{CC}$ induced in charge coil 82 by revolution of the magnet assembly. The waveform $V_{tr}$ induced in primary coil 90 by revolution of the magnet assembly is illustrated in FIG. 4B. It can be seen that waveform $V_{tr}$ leads waveform $V_{CC}$ by about 35° in this example.

FIG. 4C shows the voltage $V_{CH}$ on charge capacitor 78. As shown, voltage $V_{CH}$ is charged to its highest level corresponding generally to the peak of voltage $V_{CC}$. The voltage on capacitor 78 is maintained at this level until the magnet assembly comes back around to induce voltage $V_{tr}$ across the primary coil. This voltage is used to provide the requisite triggering signal to SCR 88.

At lower operating speeds, the triggering signal is produced at a time $t_1$ on the falling edge of voltage $V_{tr}$. At higher RPMS, the triggering signal to gate the SCR is provided at an earlier time $t_2$. Preferably, the advance in the triggering signal ($Ø=t_1-t_2$) will be at least about ten mechanical degrees. For example, the advance produced in this manner will often be about 14–15 mechanical degrees. The fixed time at which a circuit as shown in FIG. 2 would typically trigger is indicated at $t_3$.

Figure 5C:
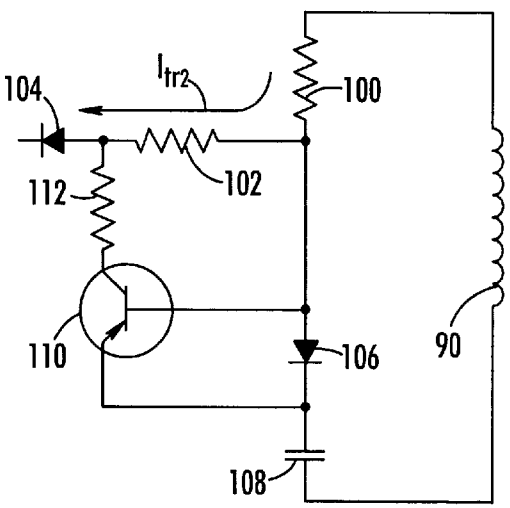
FIGS. 5A–5C are partial schematics used to explain the manner in which spark advance is achieved.
Figure 5B:
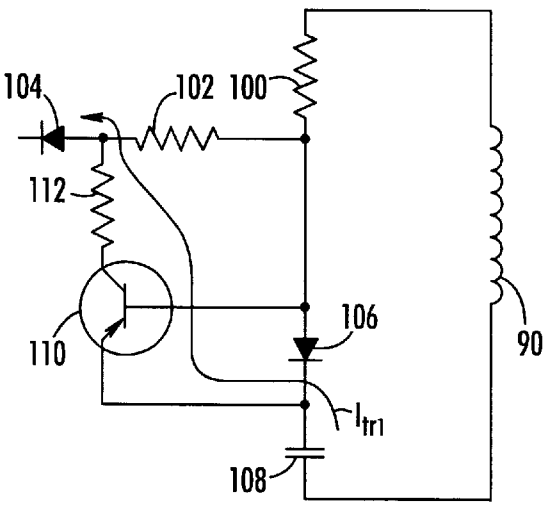
Figure 5A:
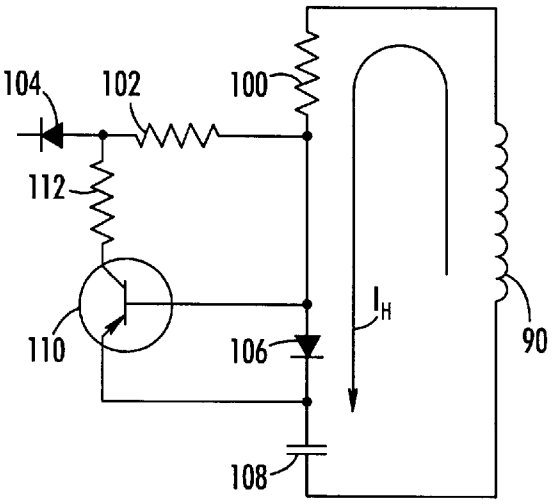

Referring now to FIGS. 5A–5C, the manner in which triggering circuitry 98 achieves this advantageous spark advance will be described. In this regard, FIG. 5A shows the operation of triggering circuit 98 at low RPM. The relatively small signal induced on primary coil 90 at these low speeds (e.g., less than about 1500 RPM) is insufficient to gate SCR 88 through the direct electrical path provided by resistors 100, 102 and diode 104. As a result, a current $I_H$ will be applied to a peak-detect circuit comprising diode 106, holding capacitor 108 and transistor 110. Specifically, current $I_H$ passes through diode 106 so as to deliver charge to capacitor 108. Capacitor 108 places this positive charge on the emitter of transistor 110 which may be a PNP bipolar transistor as shown. In this case, a resistor 112 is connected to the collector of transistor 110.

Referring now to FIG. 5B, the charge on capacitor 108 is held on the emitter of transistor 110 by diode 106 (now reverse biased) on the trailing edge of the primary coil induced voltage. At the same time, the base of transistor 110 is allowed to fall in the negative direction through resistor 100, which forward biases the base-emitter junction of transistor 110. When the charge on capacitor 108 becomes large enough, sufficient current $I_{tr1}$ will be conducted through resistor 112 and diode 104 so as to place SCR 88 in a conductive state. After the SCR is rendered conductive, the energy stored on capacitor 78 will be transferred to the spark plug as discussed above.

Referring now to FIG. 5C, the voltage induced across the primary coil will be sufficient to directly trigger SCR 88 at higher operating speeds. Thus, SCR 88 will be rendered conductive on the leading edge of waveform $V_{tr}$ at higher operating speeds rather than the trailing edge. The point at which the timing jumps from the back slope to the front slope of the primary coil induced voltage may be varied by adjusting the value of resistor 102. However, this adjustment has some impact on the total number of degrees of advance that will be obtained. Switching from back to front slope at a higher RPM tends to reduce the number of degrees the ignition can advance.

Referring back to FIG. 3, fixed resistor 114 and thermistor 116 are provided for the purpose of temperature compensation.

Because of the timing of the firing angle, the duration of the spark may be longer than is often the case with other ignitions. In the upper RPM range, when the circuit is being triggered on the leading edge of the signal induced in the primary coil, there is also a large positive voltage being induced on the secondary coil. At a predetermined threshold speed (e.g., about 2000 RPM), this induced secondary voltage will become large enough to sustain the spark even after the energy stored in capacitor 78 has been totally discharged. As an example, this may result in a spark duration of 500–550 microseconds as compared to 100–120 microseconds that one would expect from a typical capacitor discharge ignition circuit of this general type. The ability of a voltage induced on the secondary coil to sustain the spark was recognized in U.S. Pat. No. 5,513,619 to Chen et al., incorporated herein by reference.

While preferred embodiments of the invention have been shown and described, modifications and variations may be made thereto by those of skill in the art without departing from the spirit and scope of the present invention. For example, it may be desirable in some circuit arrangements to substitute an inductor or other circuit component as the energy storage element. Moreover, circuit arrangements are contemplated where the charge coil and transformer are both located on the same leg portion. In this case, the phasing of the trigger signal may need to be different from that described above so as to ensure that the charge capacitor will be fully charged. A half cycle of the primary coil induced voltage other than the central positive pulse can be used to produce the trigger signal in this case.

It should also be understood that aspects of various embodiments may be interchanged both in whole or in part. Furthermore, those of ordinary skill in the art will appreciate that the foregoing description is by way of example only, and is not intended to be limitative of the invention so further described in the appended claims.

What is claimed is:

1. An ignition apparatus for use with an internal combustion engine to produce an electrical spark at a spark ignition device, said apparatus comprising:

a magnet assembly operatively revolved along a circular path, said magnet assembly including a pair of pole faces;

a magnetically permeable core mounted adjacent to said circular path and having at least two leg portions each including a respective end face, said leg portions being situated such that said pole faces pass proximate to said end faces during revolution of said magnet assembly and produce a time-varying magnetic flux in said magnetically permeable core;

a transformer having a primary coil and a secondary coil related by a predetermined step-up ratio, said secondary coil electrically connected during operation to the spark ignition device;

a spark generation circuit operative to apply a primary voltage pulse to said primary coil responsive to a triggering signal, said primary voltage pulse producing a spark generating pulse in said secondary coil; and triggering circuitry electrically connected to said primary coil and operative to produce said triggering signal based on a voltage induced in said primary coil by revolution of said magnet assembly, said triggering circuitry being adapted so as to automatically produce advancement of said triggering signal at predetermined operating speeds.

2. An ignition apparatus as set forth in claim 1, wherein said spark generation circuit comprises:

(a) an energy storage element;

(b) a charge coil having a voltage induced thereon by said magnetic flux to supply charging energy to said energy storage element during each revolution of said magnet assembly; and (c) an electronic switch electrically connected in circuit with said energy storage element and said primary coil, said electronic switch being rendered conductive by application of said triggering signal thereto.

3. An ignition apparatus as set forth in claim 2, wherein said energy storage element is a charge capacitor.

4. An ignition apparatus as set forth in claim 3, wherein said transformer and said charge coil are respectively located on different leg portions of said magnetically permeable core.

5. An ignition apparatus as set forth in claim 3, wherein said electronic switch is an SCR.

6. An ignition apparatus as set forth in claim 5, wherein said magnet assembly is carried by a rotatable engine flywheel.

7. An ignition apparatus as set forth in claim 5, wherein said triggering circuitry comprises:

(a) a peak detect circuit operative to indirectly produce said triggering signal from said voltage induced in said primary coil when said triggering signal is not advanced; and (b) connection circuitry operative to directly produce said triggering signal from said voltage induced in said primary coil when said triggering signal is advanced.

8. An ignition apparatus as set forth in claim 7, wherein said triggering circuitry is adapted such that said triggering signal is produced on a trailing edge of a predetermined half cycle of said voltage induced in said primary coil when not advanced and is produced on a leading edge of said half cycle when advanced.

9. An ignition apparatus as set forth in claim 7, wherein said peak detect circuit includes a diode electrically connected to a holding capacitor, said holding capacitor being selectively discharged by a trigger switch so as to produce said triggering signal.

10. An ignition apparatus as set forth in claim 9, wherein said trigger switch is a transistor.

11. An ignition apparatus as set forth in claim 1, wherein said triggering circuitry is adapted such that said triggering signal is produced on a trailing edge of a predetermined half cycle of said voltage induced in said primary coil when not advanced and is produced on a leading edge of said half cycle when advanced.

12. An ignition apparatus as set forth in claim 11, wherein said triggering signal advances by at least about 10 degrees.

13. An ignition apparatus as set forth in claim 12, wherein said triggering signal advances by about 14–15 degrees.

14. An ignition apparatus as set forth in claim 1, wherein said triggering signal when advanced occurs at a time when a spark sustaining potential is being otherwise induced on said secondary coil.

15. A discharge circuit for use in a discharge ignition system of the type operative to produce an electrical spark at a spark ignition device, said discharge circuit comprising:

a charge capacitor;

a charge coil;

a rectifier electrically connected between said charge coil and said charge capacitor;

a transformer including a primary coil and a secondary coil, said secondary coil electrically connected during operation to the spark ignition device to produce the electrical spark;

an electronic switch electrically connected in circuit with said charge capacitor and said primary coil, said electronic switch being rendered conductive by a triggering signal applied to a triggering node thereof; and triggering circuitry electrically connected to said triggering node and operative to produce said triggering signal based on a voltage induced in said primary coil, said triggering circuitry being adapted so as to automatically produce advancement of said triggering signal at predetermined operating speeds.

16. A discharge circuit as set forth in claim 15, wherein said triggering circuitry comprises:

(c) a peak detect circuit operative to indirectly produce said triggering signal from said voltage induced in said primary coil when said triggering signal is not advanced; and (d) connection circuitry operative to directly produce said triggering signal from said voltage induced in said primary coil when said triggering signal is advanced.

17. A discharge circuit as set forth in claim 16, wherein said peak detect circuit includes a diode electrically connected to a holding capacitor, said holding capacitor being selectively discharged by a trigger switch so as to produce said triggering signal.

18. A discharge circuit as set forth in claim 17, wherein said trigger switch is a transistor.

19. A discharge circuit as set forth in claim 18, wherein said trigger switch is a PNP bipolar transistor.

20. A discharge circuit as set forth in claim 15, wherein said triggering circuitry is adapted such that said triggering signal is produced on a trailing edge of a predetermined half cycle of said voltage induced in said primary coil when not advanced and is produced on a leading edge of said half cycle when advanced.

21. A discharge circuit as set forth in claim 20, wherein said triggering signal advances by at least about 10 degrees.

22. A discharge circuit as set forth in claim 21, wherein said triggering signal advances by about 14–15 degrees.

23. A discharge circuit as set forth in claim 15, wherein said triggering signal when advanced occurs at a time when a spark sustaining potential is being otherwise induced on said secondary coil.

24. A discharge ignition apparatus for use with an internal combustion engine to produce an electrical spark at a spark ignition device, said apparatus comprising:

a movable magnet assembly, said magnet assembly including a pair of pole faces;

a magnetically permeable core having at least two leg portions each including a respective end face, said magnetically permeable core being mounted such that said pole faces pass proximate to said end faces as said magnet assembly is operatively moved in a cyclical manner to produce a time-varying magnetic flux in said magnetically permeable core;

a housing mounted to at least one of said leg portions of said magnetically permeable core;

a transformer having a primary coil and a secondary coil located in said housing and situated about said magnetically permeable core, said secondary coil electrically connected during operation to the spark ignition device; and a discharge circuit located in said housing, said discharge circuit including:

(a) an energy storage element;

(b) a charge coil situated about said magnetically permeable core and having a charging voltage induced thereon by said magnetic flux to supply charging energy to said energy storage element;

(c) an electronic switch electrically connected in circuit with said energy storage element and said primary coil, activation of said electronic switch during operation producing a voltage on said primary coil; and (d) triggering circuitry operative to activate said electronic switch at a first triggering point when said engine is operating at speeds below a predetermined threshold and at a second triggering point when said engine is operating at speeds above said predetermined threshold, said second triggering point being advanced with respect to said first triggering point and occurring at a time when a spark sustaining potential is being otherwise induced on said secondary coil.

25. A discharge ignition apparatus as set forth in claim 24, wherein said triggering circuitry is operative to activate said electronic switch by producing a triggering signal based on a voltage induced in said primary coil.

26. A discharge ignition apparatus as set forth in claim 25, wherein said triggering circuitry comprises:

(e) a peak detect circuit operative to indirectly produce said triggering signal from said voltage induced in said primary coil when said triggering signal is not advanced; and (f) connection circuitry operative to directly produce said triggering signal from said voltage induced in said primary coil when said triggering signal is advanced.

27. A discharge ignition apparatus as set forth in claim 26, wherein said triggering circuitry is adapted such that said triggering signal is produced on a trailing edge of a predetermined half cycle of said voltage induced in said primary coil when not advanced and is produced on a leading edge of said half cycle when advanced.

28. A discharge ignition apparatus as set forth in claim 24, wherein said transformer and said charge coil are respectively located on different leg portions of said magnetically permeable core.

29. A discharge ignition apparatus as set forth in claim 28, wherein said magnet assembly is carried by a rotatable engine flywheel.

* * * * *